US005873231A

United States Patent [19]

Tjin

[11] Patent Number: 5,873,231

[45] Date of Patent: Feb. 23, 1999

[54] METHOD AND DEVICE FOR OPEN END SPINNING OF YARNS

[75] Inventor: Phoa Tek Tjin, Stolberg, Germany

[73] Assignee: Volkman GmbH & Co., Krefeld, Germany

[21] Appl. No.: 901,868

[22] Filed: Jul. 29, 1997

[30] Foreign Application Priority Data

Jul. 31, 1996 [DE] Germany ..... 196 30 834.8

[51] Int. Cl.[6] ..... D01H 4/00

[52] U.S. Cl. ..... 57/416; 57/404; 57/413; 57/414

[58] Field of Search ..... 57/404, 406, 407, 57/414, 415, 416, 417

[56] References Cited

U.S. PATENT DOCUMENTS

| | | | |
|---|---|---|---|
| 3,481,130 | 12/1969 | Kubovy et al. | 57/416 |
| 3,757,506 | 9/1973 | Kutscher et al. | 57/414 |
| 4,058,964 | 11/1977 | Stadler | 57/416 |
| 4,237,682 | 12/1980 | Miyamoto | 57/416 |
| 4,241,572 | 12/1980 | Le Chatelier | 57/416 |
| 4,299,084 | 11/1981 | Seiki et al. | 57/416 |
| 5,109,663 | 5/1992 | Stahlecker et al. | 57/415 |
| 5,675,965 | 10/1997 | Mackey et al. | 57/414 |
| 5,718,110 | 2/1998 | Stahlecker | 57/404 |

FOREIGN PATENT DOCUMENTS

| | | |
|---|---|---|
| 1710038 | 9/1971 | Germany . |
| 2544503 | 4/1977 | Germany . |
| 3018474 | 11/1980 | Germany . |
| 593356 | 11/1977 | Switzerland . |

OTHER PUBLICATIONS

Dr.–Ing. havil, Günter Trommer et al; Faserbewegung auf der Rotorwand; May 1995; pp. 308–311.

*Primary Examiner*—William Stryjewski
*Attorney, Agent, or Firm*—Robert W. Becker & Associates

[57] ABSTRACT

An open end spinning method includes the step of providing a spinning chamber with an annular slip wall. A sliver of fiber material is placed onto the annular slip wall that widens continuously in the direction of sliver introduction into the spinning chamber. The angle of the annular slip wall to a rotational axis of the spinning chamber is between 8° and 12°. A yarn is formed from the fiber material in the yarn formation zone which is located within the portion of the annular slip wall upstream of a widest diameter of the annular slip wall viewed in the direction of sliver introduction. The fiber material is removed as a yarn from the spinning chamber through a yarn removal channel, extending along the rotational axis of the spinning chamber, in the direction opposite the direction of sliver introduction.

8 Claims, 2 Drawing Sheets

METHOD AND DEVICE FOR OPEN END SPINNING OF YARNS

BACKGROUND OF THE INVENTION

The present invention relates to a method for open-end spinning of yarns in a rotating spinning chamber. The fiber material in the form of a sliver is placed onto a continuously widening slip wall of the spinning chamber in the direction of sliver introduction. The angle of the slip wall relative to the axis of rotation of the spinning chamber is between 8° to 12°, and the yarn is removed from the spinning chamber in a direction counter to the direction of introduction of the sliver through a yarn removal channel which is positioned along the axis of rotation of the spinning chamber.

Conventional spinning rotors for an open end spinning device comprise concentrical inner surfaces with a groove provided as a fiber material collecting location at the position of the greatest inner diameter of the rotor. The groove is formed by two surfaces, one of which is the so-called slip wall to which the fiber material in the form of a sliver is guided and the other is the so-called draw-off wall. In such spinning rotors the introduced fiber material is placed onto a collecting surface and glides into the slip wall in the form of a V-shaped groove where the fibers are compressed to form a band of a substantially triangular cross-section. The fiber material is then removed from this V-shaped groove along the draw-off wall. The resulting yarn is provided with a substantially circular mantle surface during this process, i.e., the resulting yarn has a substantially circular cross-section.

Such methods and the corresponding devices are substantially disclosed in German Offenlegungsschrift 17 10 038, 25 44 503, and 30 18 474 as well as in Swiss Patent 593 356.

According to a publication in "Melliand Textilberichte", 5/1995, pages 308, 310/311, the open end spinning method requires with respect to yarn quality that all fibers, when approaching the rotor groove, should have only a minimal differential velocity relative to the rotor. The time for reaching the rotor groove increases with a longer gliding path, for example, when the fiber material impinges closer to the edge of the rotor;

minimal starting velocity, for example, when the supplied vacuum is low;

small fiber gliding angle $\alpha$, for example, required due to constructive considerations in small rotors, whereby the conventional values are $\alpha$ equal 12° to 25°;

increased frictional coefficient, for example, when the rotor wall has a rough surface.

The prior art thus teaches that, when considering the aforementioned parameters, it must be ensured at all times that the fibers be deposited in the rotor groove.

Conventionally, textile spun yarns of staple fibers, independent of the type of spinning method, are designed to have a uniform circular cross-section. It is presumed that the thus structured yarns are used for producing fabrics by weaving, knitting, etc. which correspond to the conventionally desired products. Such textile fabrics have a uniform, knobbly surface structure, especially when yarns with a high degree of twist or twisted yarns are used.

When it is desired to provide the fabric with a special textile surface structure or when it is desired to produce special visual effects, specialty yarns must be used, for example, yarns with non-uniform or changing cross-section, for example, fancy yarns. It is also possible to provide such special effects by weaving, knitting etc. by providing a respective bonding or pattern for forming the surface of the textile cloth (fabric) or other textile materials.

It is therefore an object of the present invention to produce an open end spun yarn with a non-circular cross-section with which it is possible to change the textile surface appearance or surface structure only by using this special yarn or a twisted yarn made thereof.

SUMMARY OF THE INVENTION

An open-end spinning method according to the present invention is primarily characterized by:

providing a spinning chamber with an annular slip wall;

placing a sliver of fiber material onto the annular slip wall widening continuously in a direction of sliver introduction into the spinning chamber, wherein an angle of the annular slip wall to the rotational axis of the spinning chamber is between 8° and 12°;

forming a yarn from the fiber material in a yarn formation zone located within a portion of the annular slip wall upstream of a widest diameter of the annular slip wall viewed in the direction of sliver introduction;

removing the fiber material as a yarn from the spinning chamber through a yarn removal channel, extending along the rotational axis of the spinning chamber, in a direction opposite to the direction of sliver introduction.

Advantageously, the annular slip wall widens conically.

The step of forming the yarn preferably includes rotating the yarn formation zone at a circumferencial velocity of 160 to 180 m/s and wherein in the step of removing the yarn is removed at a removal velocity of 80 to 159 m/min.

The present invention also relates to an open end spinning device which is primarily characterized by:

a spinning chamber with an annular slip wall, wherein a sliver of fiber material is placed onto the annular slip wall widening continuously in the direction of sliver introduction into the spinning chamber, wherein the angle of the annular slip wall to the rotational axis of the spinning chamber is between 8° and 12°;

the annular slip wall comprising preferably a yarn formation zone located within a portion of the annular slip wall upstream of a widest diameter of the annular slip wall viewed in the direction of sliver introduction;

the spinning chamber having a yarn removal channel, extending along a rotational axis of the spinning chamber, for removing the yarn formed in the yarn formation zone, from the spinning chamber in a direction opposite to the direction of sliver introduction.

Advantageously, the annular slip wall extends conically.

In an alternative embodiment of the present invention, the annular slip wall widens arc-shaped or widens parabolically.

Preferably, the yarn formation zone rotates at a circumferencial velocity of 160 to 180 m/s and the yarn is removed at a removal velocity of 80 to 159 m/min.

Inventively, the fiber material which is supplied into the spinning chamber especially by vacuum suction, is not collected in a V-shaped collecting groove and compressed before the fiber material is formed within the yarn formation zone at the draw-off wall. Instead, the fiber material slip wall is inventively also the draw-off wall, i.e., the fiber material is formed to a yarn in the area of the continuously widening slip wall onto which the supplied fiber material is placed in the form of a relatively flat sliver. This is the prerequisite for a yarn to have a cross-section that deviates from a circular cross-section, for example, has a substantially oval cross-section.

When using such an oval yarn, the character or appearance of the textile fabric material can be greatly influenced. For example, when at least two of such non-round, oval spun fibers are used to produce a twisted yarn, a twisted yarn with a substantially oval cross-sectional geometry results. The use of such twisted yarns results in different characteristics of the thus produced textile fabric.

BRIEF DESCRIPTION OF THE DRAWINGS

The object and advantages of the present invention will appear more clearly from the following specification in conjunction with accompanying drawings, in which.

DESCRIPTION OF PREFERRED EMBODIMENTS

Figure 1:
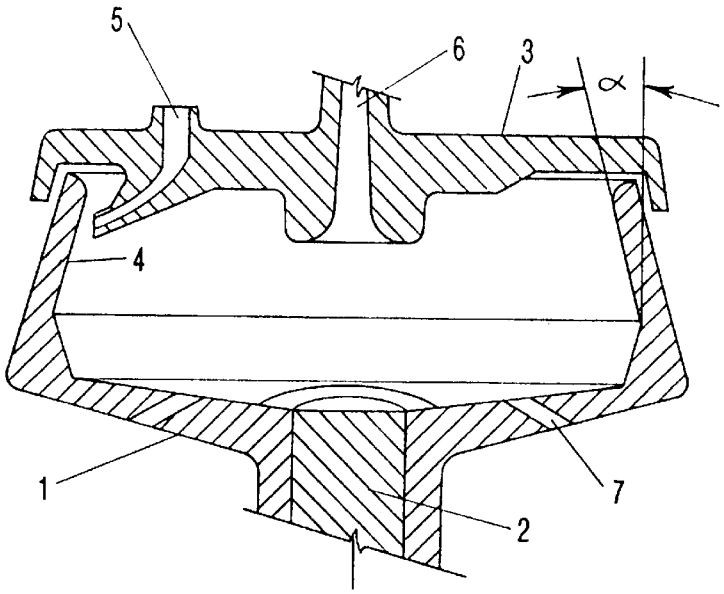
FIG. 1 is a schematic cross-sectional view of a spinning rotor.

The present invention will now be described in detail with the aid of several specific embodiments utilizing FIGS. 1–2.

The open end spinning device or rotor 1 is rotatably supported within a non-represented housing. FIG. 1 only shows the stationary cover 3 provided for covering the open rotor side.

Supply channel 5 as well as removal channel 6 extend through the cover lid 3, whereby the fiber material supply channel 5 points toward the slip wall. The essentially closed bottom of the spinning rotor 1 is provided with venting holes 7.

The construction and function of this spinning rotor corresponds to that of conventional spinning rotors.

The fiber material slip wall (collecting surface) 4 widens in the direction of sliver introduction in the form of a cone whereby the conical surface has an angle to the rotational axis of the spinning rotor of $\alpha$ between 8° to 12°. In contrast to the embodiment of the conical collecting surface 4 as shown, it can be embodied so as to have a continuously curved collecting surface in the form of an arc, whereby the angle of $\alpha$ 8° to 12° is also provided.

Figure 2:
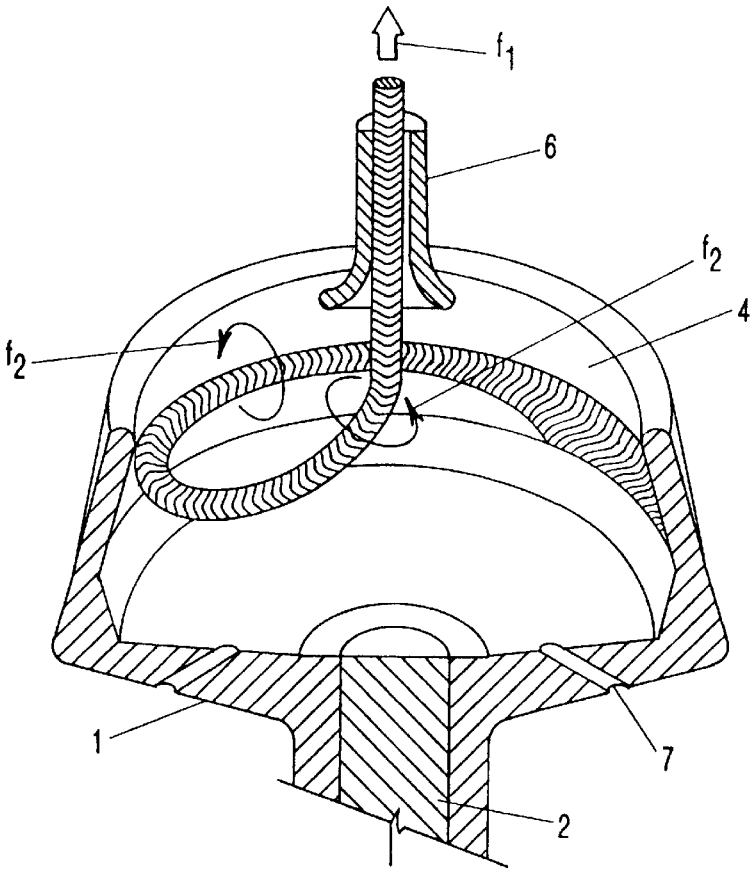
FIG. 2 is a part-sectional view of a schematic representation of a spinning rotor including the representation of the sliver that is applied with its wide surface onto the slip wall.
Figure 3:
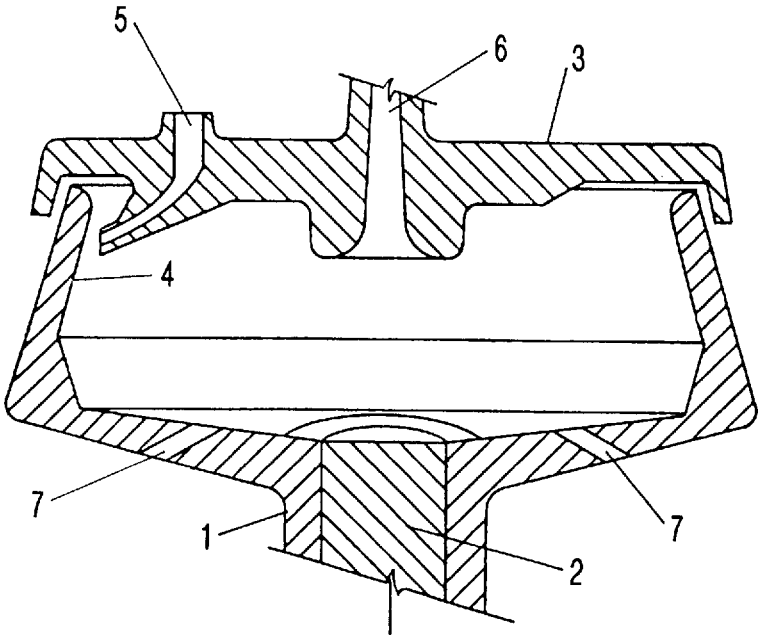
FIG. 3 shows a cross-sectional view of a spinning rotor with an arc-shaped annular slip wall.
Figure 4:
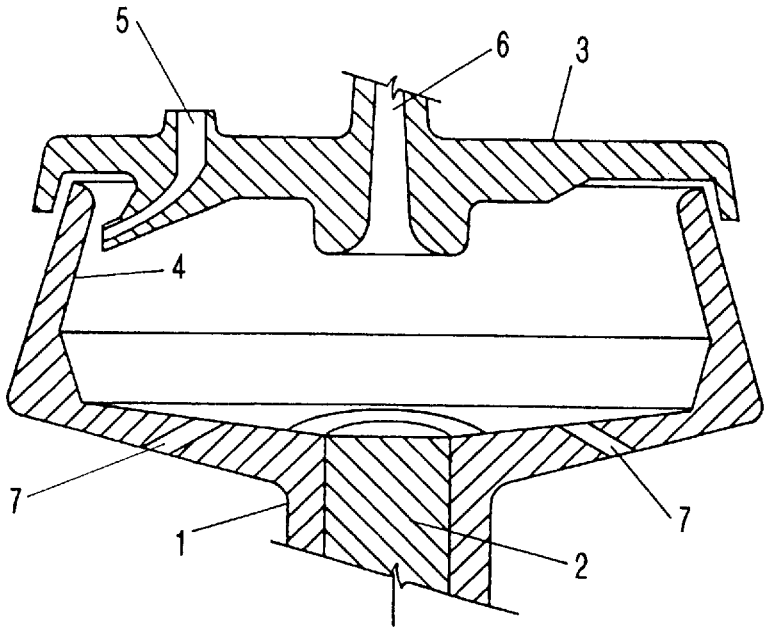
FIG. 4 shows a cross-sectional view of a spinning rotor with a parabolic annular slip wall.

FIG. 2 shows schematically that, in deviation from the conventional methods used in connection with spinning rotors, the fiber material collecting surface 4 is used at the same time is used as the slip wall or draw-off wall such that the formation of a yarn from the fiber material is performed within a yarn formation zone which is positioned within a portion of the fiber material slip wall above the greatest inner diameter of the annular slip wall. In this manner it is ensured that the yarn formation takes place at a location at which the fiber material is still in the form of a relatively wide sliver. For achieving the inventive goal, it is essential to prevent the fiber material from collecting and compressing within a substantially V-shaped fiber collecting groove before the yarn formation takes place. The inventively preferred method parameters are as follows: a circumferencial velocity within the yarn formation zone should be between 160 to 180 m/s and the yarn removal velocity should be between 80 to 159 m/min.

For the inventive method it is important that the yarn removal direction (arrow f1) is oriented counter to the sliver introduction direction because then the direction of the yarn torsional moment (represented by arrow f2) causes a movement component away from the location of the greatest inner diameter of the spin rotor.

The goal of providing a flat sliver shortly before and within the area of the yarn formation zone can be controlled to a certain extent also by the penetration depth of the yarn removal channel 6 into the spinning rotor 1.

The present invention is, of course, in no way restricted to the specific disclosure of the specifications, and drawings, but also encompasses any modifications within the scope of the appended claims.

What I claim is:

1. An open-end spinning method comprising the steps of:

providing a spinning chamber with an annular slip wall;

placing a sliver of fiber material onto the annular slip wall widening continuously in a direction of sliver introduction into the spinning chamber, wherein an angle of the annular slip wall to a rotational axis of the spinning chamber is between 8° and 12°;

forming a yarn from the fiber material in a yarn formation zone located within a portion of the annular slip wall upstream of a widest diameter of the annular slip wall viewed in the direction of sliver introduction;

removing the fiber material as a yarn from the spinning chamber through a yarn removal channel, extending along a rotational axis of the spinning chamber, in a direction opposite to the direction of sliver introduction.

2. A method according to claim 1, wherein the annular slip wall widens conically.

3. A method according to claim 1, wherein the step of forming the yarn includes rotating the yarn formation zone at a circumferential velocity of 160 to 180 m/s and wherein in the step of removing the yarn is removed at a removal velocity of 80 to 159 m/min.

4. An open-end spinning device comprising:

a spinning chamber with an annular slip wall, wherein a sliver of fiber material is placed onto said annular slip wall widening continuously in a direction of sliver introduction into said spinning chamber, wherein an angle of said annular slip wall to a rotational axis of said spinning chamber is between 8° and 12°;

said annular slip wall comprising a yarn formation zone located within a portion of said annular slip wall upstream of a widest diameter of said annular slip wall viewed in the direction of sliver introduction;

said spinning chamber having a yarn removal channel, extending along a rotational axis of said spinning chamber, for removing the yarn, formed in said yarn formation zone, from said spinning chamber in a direction opposite to the direction of sliver introduction.

5. A device according to claim 4, wherein said annular slip wall extends conically.

6. A device according to claim 4, wherein said annular slip wall widens arc-shaped.

7. A device according to claim 4, wherein said annular slip wall widens parabolically.

8. A device according to claim 4, wherein said yarn formation zone rotates at a circumferential velocity of 160 to 180 m/s and wherein the yarn is removed at a removal velocity of 80 to 159 m/min.

* * * * *